US006309056B1

(12) United States Patent
Sando et al.

(10) Patent No.: US 6,309,056 B1
(45) Date of Patent: Oct. 30, 2001

(54) INK JET HEAD, DRIVE METHOD OF INK JET HEAD, AND INK JET RECORDING APPARATUS

(75) Inventors: Yasuhiro Sando, Amagasaki; Kusunoki Higashino, Osaka; Hisashi Takata, Nishinomiya; Yasuhisa Fujii, Kyoto; Hideo Hotomi, Nishinomiya, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/298,510

(22) Filed: Apr. 22, 1999

(30) Foreign Application Priority Data

Apr. 28, 1998 (JP) ..... 10-119435
Apr. 28, 1998 (JP) ..... 10-119436

(51) Int. Cl.[7] ..... B41J 2/045
(52) U.S. Cl. ..... 347/70; 347/71; 347/68
(58) Field of Search ..... 347/68, 70, 71

(56) References Cited

U.S. PATENT DOCUMENTS 4,228,440 * 10/1980 Horike et al. ..... 347/48

FOREIGN PATENT DOCUMENTS 5-050601 3/1993 (JP) .

* cited by examiner

*Primary Examiner*—Thinh Nguyen
(74) *Attorney, Agent, or Firm*—Sidley Austin Brown & Wood

(57) ABSTRACT

An ink jet head for a printer wherein an ink drop is ejected from a nozzle to fly and land on the recording paper to form an image. The ink jet head includes the nozzle for ejecting ink, an ink channel that communicates with the nozzle, a pair of oscillating plates that are opposing to each other on walls of the ink channel, a pair of electrodes disposed in contact with the oscillating plates, an ink chamber for holding the ink, and an inlet for supplying the ink from the ink chamber to the ink channel. A gap between the electrodes is filled with the ink having a relative dielectric constant higher than air. A voltage is applied between the electrodes.

26 Claims, 15 Drawing Sheets

FORM CrAu LAYER INSIDE THROUGH HOLE FROM THE BACKSIDE
FORM CrAu ELECTRODE FROM THE FRONT SIDE

FORM SiC LAYER AS PROTECTIVE LAYER ON TOP OF ELECTRODE

FORM LOW MELTING POINT GLASS LAYER

INK JET HEAD, DRIVE METHOD OF INK JET HEAD, AND INK JET RECORDING APPARATUS

This application is based on Japanese Patent Application Nos. 10-119435 and 10-119436 filed on Apr. 28, 1998, the contents of which are hereby incorporated by reference.

BACKGROUND OF THE INVENTION

1. Field of the Invention

The present invention relates to ink jet head, drive method thereof, and ink jet recording apparatus for causing ink to fly across a space with the help of deformation of an oscillating plate by means of electrostatic force.

2. Description of the Related Art

An ink jet type recording apparatus causes an ink drop to be ejected from a nozzle and thrown across a space to land on a recording medium to form an image. A number of ink jet heads have been invented to be used on such a recording apparatus. As an example, Japanese laid-open Patent Publication, JP-A-05-50601, discloses an ink jet head that uses an electrostatic actuator that ejects ink with the help of deformation of an oscillating plate by electrostatic force.

This electrostatic ink jet head has a laminar structure composed of three members joined together, i.e., a channel plate provided with a plurality of recesses, a glass substrate positioned opposite to the bottom surface of the recesses, and a cover plate. The recesses form a nozzle that ejects an ink drop, an ink channel that communicates with the nozzle, an oscillating plate that changes the pressure in the ink channel, a common ink chamber where ink is stored, and an inlet that serves as an ink supply port from the common ink chamber to the ink channel. The bottom wall of the ink channel forms an oscillating plate to generate the pressure for ejecting ink. A plurality of ink channels and nozzles are provided in accordance with the number of dots to be printed at a time. Moreover, a first electrode is provided on the surface of the side which is not facing the ink channel, or on the backside of the oscillating plate. A second electrode is provided on the surface of the glass substrate opposing the first electrode separated by a small gap from the first electrode. The recesses provided on the backside of the oscillating plate and the top surface of the substrate also serves as the members to form these electrodes.

The electrostatic type ink jet ejects ink based on the following operating principle to form an image on the recording medium.

First of all, when a voltage is applied between the first electrode and the second electrode by means of a drive circuit, an electrostatic force is generated between the electrodes. Accordingly, the oscillating plate deforms by being drawn in the direction toward the second electrode, or in the direction of moving itself away from the ink channel, which is communicating with the nozzle. At this time, the volume of the ink channel increases. Therefore, ink is drawn through the inlet into the ink channel to fill it up. Next, the application of the voltage between the first and second electrodes as opposing electrodes is terminated and the charges are discharged. The oscillating plate returns to its original position by the restoring force due to its own rigidity. In the mean time, the oscillating plate sharply compresses the volume of the ink channel to generate a pressure. Consequently, the ink stored in the ink channel is ejected, flies across a space, and lands on the recording medium to form an image.

Such an electrostatic jet head has an advantage of allowing us to realize a higher density constitution and to print using a relatively low voltage in comparison with the method of ejecting ink using the deformation of a piezoelectric device.

However, it is necessary to make the gap between the first and second electrodes extremely small in order to reduce the applied voltage on an electrostatic ink jet head. For example, the electrode gap is set to about 0.3 $\mu$m. Consequently, it is necessary to produce and assemble individual components such as the channel plate with extreme accuracy in manufacturing the head.

Moreover, since the electrode gap is only about 0.3 $\mu$m, there is a danger of causing a short circuit between the first electrode as an individual electrode and the second electrode as a common electrode when the oscillating plate is oscillated. In order to prevent the short circuit, a protective layer can be provided on top of the electrode. However, a problem with the protective layer is that it is susceptible to chronological changes.

The pressure P generated by the electrostatic ink jet head can be expressed by the following formula:

$$P=1/2\cdot\{\in_r\cdot\in_o\cdot(V/G)^2\}$$

wherein the symbol $\in_r$ denotes the relative dielectric constant between the opposing electrodes, the symbol $\in_o$ denotes the dielectric constant in vacuum, $8.8\times10^{-12}$ [F/m], the symbol V denotes the applied voltage [V], and the symbol G denotes the distance between the electrodes [m].

In case of the conventional electrostatic type ink jet head, air is inserted, whose relative dielectric constant is 1, in the gap between the opposing electrodes. Therefore, it is necessary to set the gap G between the electrodes as small as 0.3 $\mu$m as mentioned above in order to generate a sufficient pressure to cause ink to fly using, for example, a drive voltage of 40V. The manufacture of such a head has a problem that it requires high precision machining and assembly practices.

Incidentally, the electrostatic type ink jet head uses a constitution of causing the ink in the ink channel to be ejected and fly by means of deforming the oscillating plate as mentioned above. Therefore, a situation can occur, in which the mechanical constitution can no longer follow the demand when the drive frequency of the ink head, or the frequency of the voltage applied between a pair of electrodes is increased in case of continuous printing. Thus, the ink jet head drive frequency is limited by the natural frequency of the ink in the ink channel and the natural frequency of the oscillating plate.

Therefore, a problem has been noted that there is a limit to the improvement of the head response by means of increasing the drive frequency of the ink jet head.

SUMMARY OF THE INVENTION

An object of the invention is to provide an improved apparatus that is capable of solving the problems described above.

Another object of the invention is to provide an ink jet head that allows the use of a larger gap between the electrodes and to make manufacturing easier thus enhancing its reliability.

Another object of the invention is to increase the restoring force of the oscillating plate so that the drive frequency of the ink jet can be improved.

One aspect of the invention is an ink jet head having an ink channel, a pair of oscillating plates, and a pair of electrodes. The ink channel is filled with ink that communicates with a nozzle that ejects ink. The oscillating plates are disposed opposing to each other on walls of the ink channel. The electrodes are provided in contact with the oscillating plates respectively. In addition, a voltage is applied between the electrodes.

Another aspect of the invention is an ink jet recording apparatus having an ink channel, a pair of oscillating plates, a pair of electrodes, and a controller. The ink channel is filled with ink that communicates with a nozzle that ejects ink. The oscillating plates are disposed opposing to each other on walls of the ink channel. The electrodes are disposed in contact with the oscillating plates, respectively. And, the controller controls a voltage to be applied between the electrodes.

Another aspect of the invention is an ink jet head having an ink channel, an oscillating plate, a first electrode, a second electrode, and a third electrode. The ink channel communicates with a nozzle that ejects ink. The oscillating plate is disposed facing the ink channel. The first electrode is disposed on the oscillating plate and a side where the first electrode is disposed is opposite to a side that faces the ink channel. The second electrode is disposed opposing the first electrode. And, the third electrode is located relative to the first electrode on a side opposite to a side the second electrode is located.

Another aspect of the invention is an ink jet recording apparatus having an ink channel, an oscillating plate, a first electrode, a second electrode, a third electrode, and a controller. The ink channel communicates with a nozzle that ejects ink. The oscillating plate is disposed facing the ink channel. The first electrode is disposed on the oscillating plate and a side where the first electrode is disposed is opposite to a side that faces the ink channel. The second electrode is disposed opposing the first electrode. The third electrode is located relative to the first electrode on a side opposite to a side the second electrode is located. And, the controller controls application of voltages on the electrodes.

Another aspect of the invention is a method for driving an ink jet head, including an oscillating plate, that is disposed facing an ink channel, a first electrode disposed on the oscillating plate, a side where the first electrode is disposed being opposite to a side that faces the ink channel, a second electrode that is disposed opposing the first electrode, and a third electrode located relative to the first electrode on a side opposite to a side the second electrode is located. The method contains the steps of a first voltage application step that applies a voltage between the first and second electrodes, and a second voltage application step that applies a voltage between the first and third electrodes.

The objects, characteristics, and advantages of this invention other than those set forth above will become apparent from the following detailed description of the preferred embodiments, which refers to the annexed drawings.

DETAILED DESCRIPTION OF THE EMBODIMENTS

The embodiments of this invention will be described below with reference to the accompanying drawings.

Embodiment 1

Figure 1:
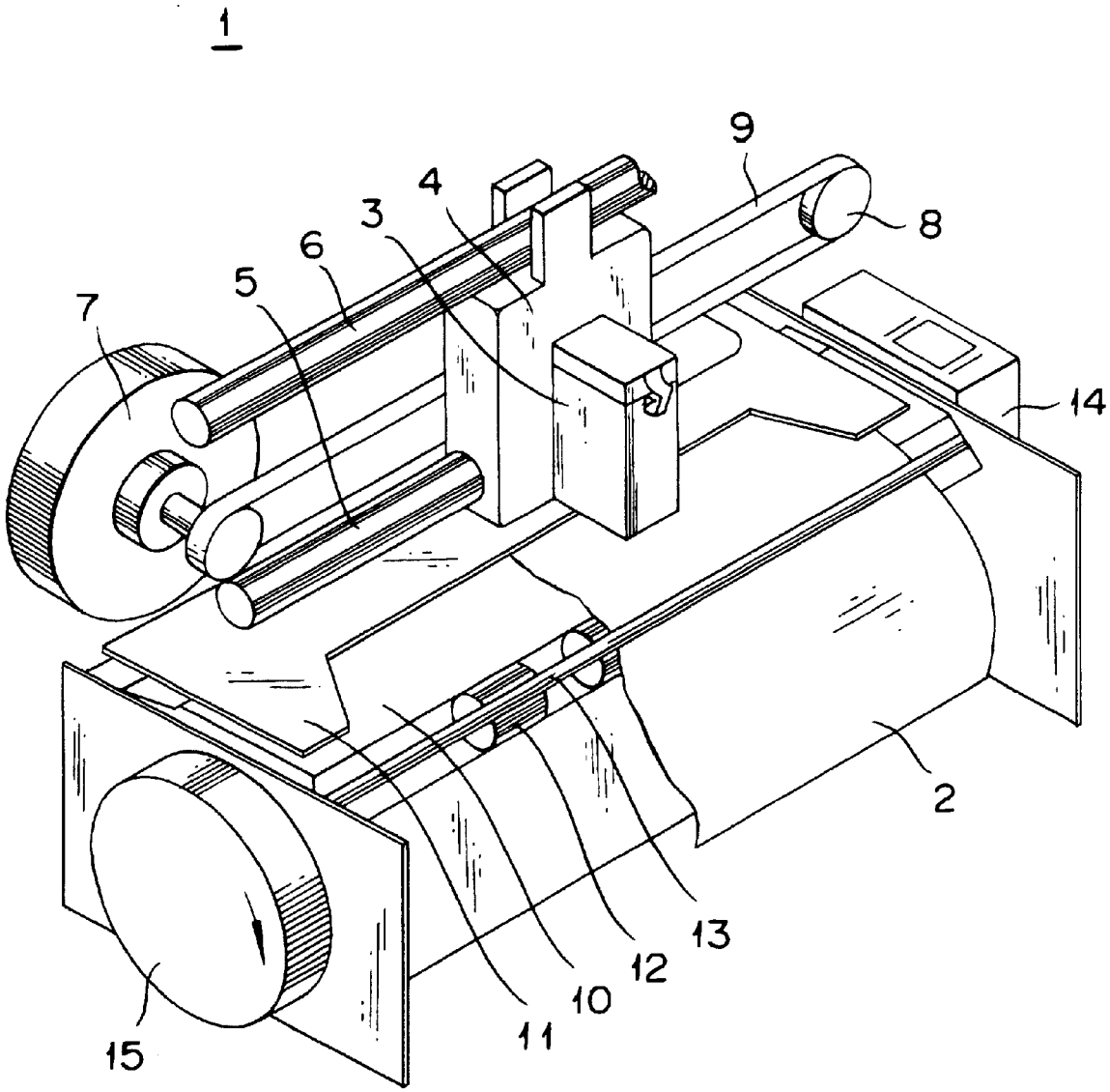
FIG. 1 is a perspective view of an ink jet printer using an ink jet head according to the embodiment 1.

The ink jet printer 1 shown in FIG. 1 is intended for forming or recording an image on a sheet 2, which is a recording medium such as a sheet of paper or an OHP sheet, and consists of a head scanning system and a sheet feeding system.

The head scanning system includes a head unit 3 having an ink jet type print head, a carriage 4 for holding a head unit 3, a scan shaft 5 and a guide shaft 6 that guide the carriage 4 for reciprocating in parallel with a surface of the sheet 2 where an image is formed, a pulse motor 7 that drives the carriage 4 to reciprocate along the guide shaft 6, and a timing belt 9 and an idle pulley 8 for converting the rotation of the pulse motor 7 into a reciprocating motion of the carriage 4. A single print head or a plurality of print heads are provided depending on the number of colors (3, 4 or 7 colors) used.

On the other hand, the sheet feeding system includes a platen 10 that also serves as a guide plate for guiding the sheet 2 along its transportation passage, a pressure plate 11 that holds down the sheet 2 against the platen 10 to prevent the sheet 2 from floating, a discharge roller 12 and a pressure roller 13 for discharging the sheet 2, a maintenance device 14 for washing the nozzle surface of the head unit 3 that ejects the ink to correct poor ink ejection condition and to restore the nozzle surface to a better condition, and a knob 15 for manually transporting the sheet 2.

The sheet 2 is transported by means of a manual feeding or a sheet feeding mechanism (not shown) such as a cut sheet feeder into a recording unit where the head unit 3 and the platen 10 are disposed opposing to each other. The transportation of the sheet to the recording unit is controlled by the number of revolutions of a sheet feeding roller driven by a sheet feed motor. The sheet feeding motor and the sheet feeding roller are not shown here.

An electrostatic type ink jet head 31, which is an electrostatic actuator and will be described later in detailed, is used as the print head of the head unit 3. Formation or recording of an image is executed by an ink drop ejected from the ink jet head 31 landing on the sheet 2.

The carriage 4 is driven laterally (main scanning direction) relative to the sheet 2 by means of the pulse motor 7, the idle pulley 8, and the timing belt 9. Accordingly, the head unit 3 mounted on the carriage 4 forms an image of one line in the lateral or main scanning direction on the sheet 2. In the mean time, the sheet is fed vertically (secondary scanning direction) when recording of one line is completed. Thus, an image can be formed or recorded on the sheet 2.

The sheet 2 that has passed the recording unit is discharged with the help of the discharge roller 12 provided on the feed direction side, or on the downstream side and the pressure roller 13 that makes contact with the discharge roller 12 under pressure.

Figure 2:
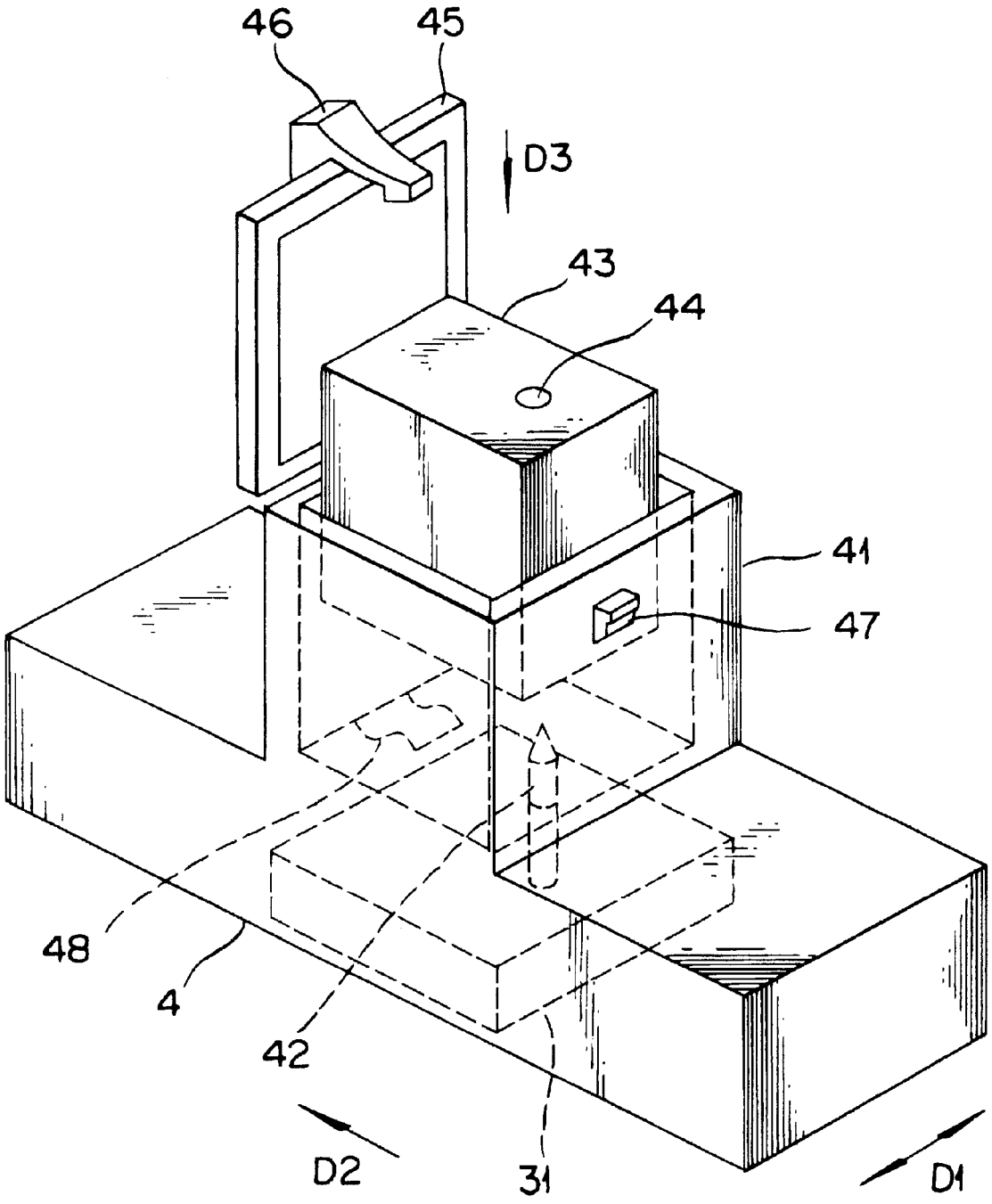
FIG. 2 is a perspective view of a carriage that contains the ink jet head for one color of the head unit shown in FIG. 1.

As shown in FIG. 2, provided in the vicinity of the carriage 4 are an ink cartridge 43 with an air hole 44, a casing 41 and a casing lid 45 for containing the ink cartridge 43, an ink supply tube 42 to which the ink cartridge 43 is detachably connected for supplying ink to the ink jet head 31, a hook 46 and a lid stop 47 used for affixing the casing lid 45 to the casing 41 when the casing lid 45 is closed, and a pressure spring 48 for urging the ink cartridge 43 in the casing 41 while the casing lid 45 is closed, in the direction opposite to the direction of the arrow D3, or to the direction of inserting the ink cartridge 43.

As the carriage 4 having such a constitution moves laterally, or in the direction of the arrow D1, one line of image in the main scanning direction is recorded on the sheet 2. Also, as the sheet 2 is driven in a vertical direction, or the direction of the arrow D2, the motion in the secondary scanning direction is executed for recording the next line of image.

Next, the constitution of the ink jet head 31 will be described in detail referring to FIGS. 3, 4 5A and 5B.

Figure 3:
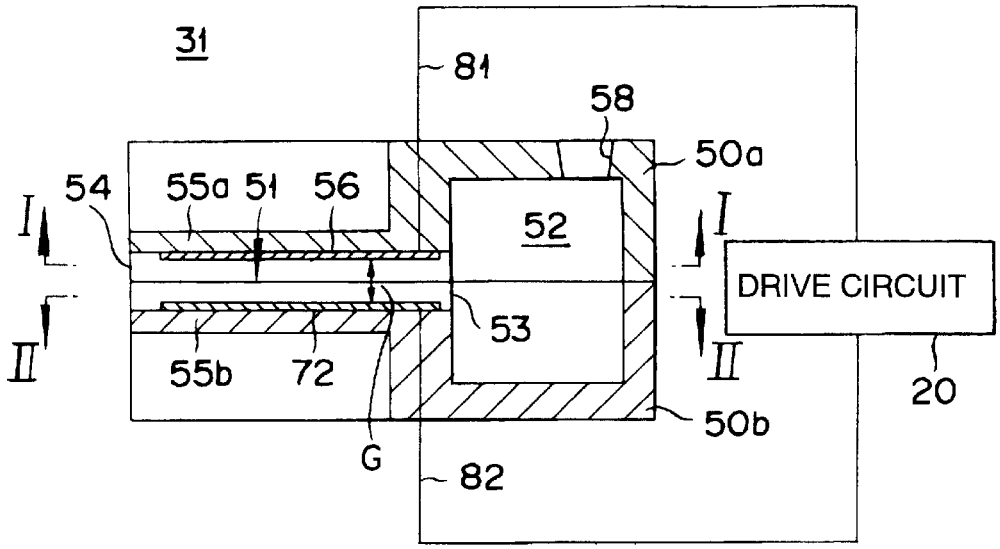
FIG. 3 is a sectional view of the ink jet head.
Figure 4:
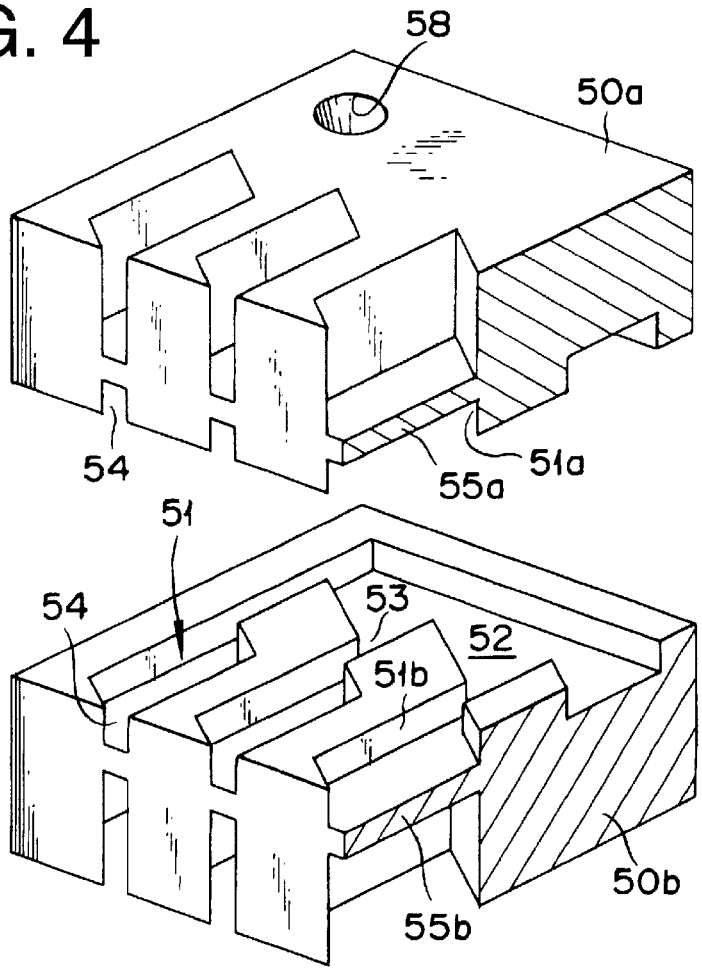
FIG. 4 is an exploded perspective view of a channel plate of the ink jet shown in FIG. 3.

The electrostatic ink jet head 31 shown in FIG. 3 is of an edge eject type that ejects an ink drop from an nozzle 54 provided on the head side end shown on the left end of the drawing. The ink jet head 31 includes two channel plates 50*a* and 50*b*, each having several recesses, stacked as one on top of the other as shown in FIG. 4. The channel plates 50*a* and 50*b* are made of single crystal silicone.

By stacking the channel plates 50*a* and 50*b* in such a way that the recesses provided in the inside are facing to each other, they jointly constitute a plurality of nozzles 54 for ink ejection, a plurality of ink channels 51 that respectively communicate with nozzles 54 to generate pressures for ink ejection, a common ink chamber 52 for storing ink supplied from a tank (not shown), and a plurality of inlets 53, which serve as an ink supply port from the common ink chamber 52 to each ink channel 51.

For example, the ink channel 51 is formed by matching a recess 51*a* formed in a channel plate 50*a* shown in the upper portion of FIG. 4 and a recess 51*b* formed in a channel plate 50*b* shown in the lower portion thereof. The symbol "58" shows the ink supply port for introducing ink to the common ink chamber 52.

A pair of oscillatory plates 55*a* and 55*b* are formed by the upper and lower walls of the ink channel 51 that are opposing to each other. The volume and inner pressure of the ink channel 51 are variable as the oscillating plates 55*a* and 55*b* make minute displacements.

Figure 5A:
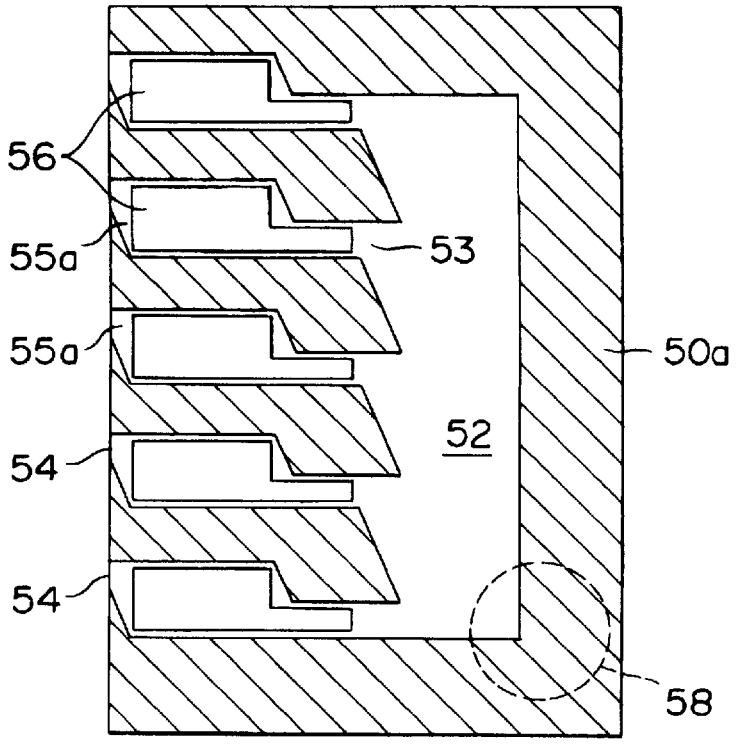
FIG. 5A and FIG. 5B are sectional views along the line I—I and the line II—II of FIG. 3, respectively.
Figure 5B:
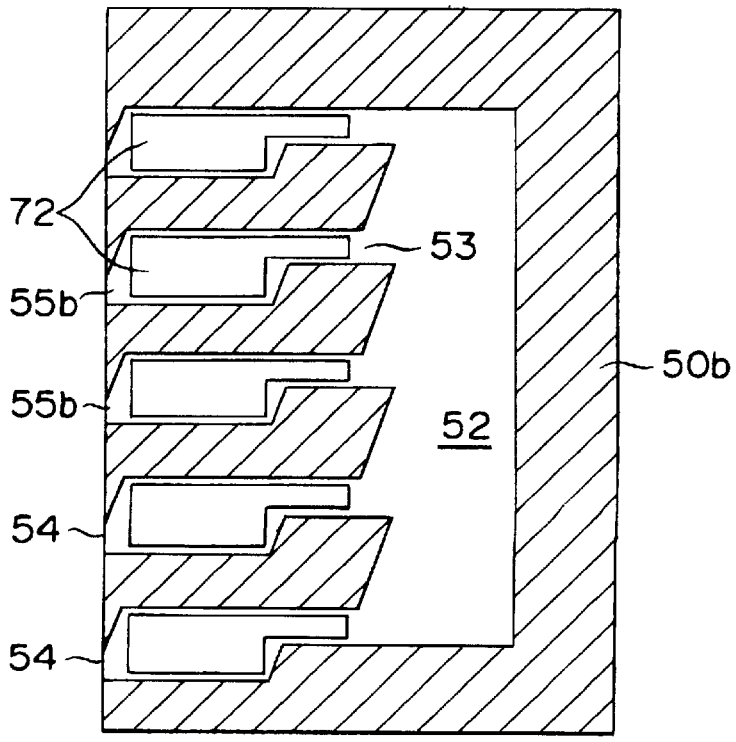

As shown in FIG. 3 and FIG. 5A, a first electrode 56 is provided on the inner surface of the oscillating plate 55*a* that faces the ink channel 51. A second electrode 72 is provided on the inside of the oscillating plate 55*b* as shown in FIG. 3 and FIG. 5B. Also, the first electrode 56 is a common electrode as shown in FIG. 3, and the second electrode 72 is an individual electrode or a drive electrode, both of which are connected to a drive circuit 20 via wires 81 and 82.

By applying a voltage from the drive circuit 20 to a pair of electrodes 56 and 72, the pair of oscillating plates 55*a* and 55*b* are attracted to each other so that the volume of the ink channel 51 contracts sharply. The pressure generated at this time causes an ink drop to be discharged from the nozzle 54. On the other hand, when the application of the voltage to the electrodes is stopped, causing an electric discharge, the oscillating plates 55*a* and 55*b* are restored to their original shapes due to their own restoring forces resulting from their rigidities and increasing the volume of the ink channel 51. As a result, ink is supplied from the common ink chamber 52 to the ink channel 51 through the inlet 53.

The first electrode 56 as the common electrode and the second electrode 72 as an individual electrode are exposed to the ink channel 51 to form a portion of the ink passage. In other words, the ink channel 51 is formed between the common electrode and the individual electrode. Therefore, the space between the pair of electrodes 56 and 72 that cause an electrostatic force contains no air but rather is filled with ink.

The relative dielectric constant $\in_r$ of water-based ink is about 60 and is larger than the relative dielectric constant $\in_r$ of air, which is 1. Obviously, the electrostatic actuator with the constitution stated above has a better efficiency because of the existence of a material with a relative dielectric constant higher than that of air between the electrodes 56 and 72. As a result, it is possible to use a larger gap G between the electrodes. For example, while the electrode gap of the conventional head is about 0.3 $\mu$m, the gap G between the electrodes in case of the head 31 according to the embodiment 1 is almost ten times of that, or about 3 $\mu$m.

Next, the method of manufacturing the ink jet head 31 will be described as an example referring to FIGS. 6A to 6H.

The ink jet head 31 is manufactured using various manufacturing processes including the semiconductor device manufacturing process and the micromachine manufacturing process. It goes without saying that the present invention is applicable to an ink jet head manufactured by a method that is not described here.

Figure 6A:
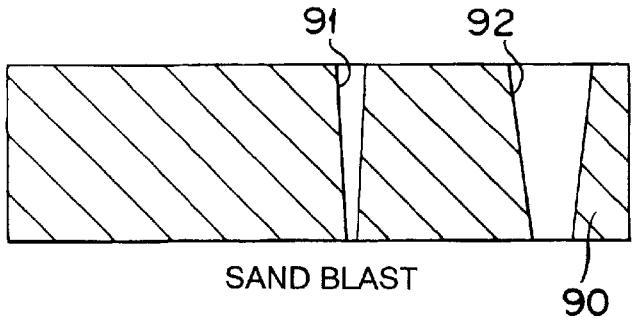
FIGS. 6A to 6H are sectional views for describing the manufacturing method of the ink jet head.

As shown in FIG. 6A, the backside (topside in the drawing) of a substrate 90 made of a single crystal silicon is sandblasted prior to etching. As a result, through-holes 91 for openings used for taking out electrodes as many as the number of the ink channels 51 are formed. At the same time, a through hole 92 for the ink supply port 58 is formed in the same way. The through holes 91 and 92 become slightly tapered narrowing at the distal ends.

Figure 6B:
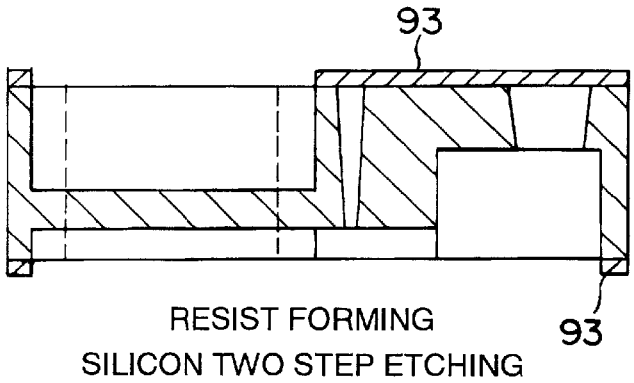

As shown in FIG. 6B, recesses for constituting the ink channels 51, the common ink chamber 52, the inlets 53, the nozzles 54 and the oscillating plates 55*a*, 55*b* are formed by means of anisotropic etching using KOH solution on the channel plates 50*a*, 50*b* More specifically, the silicon substrate 90 has a thickness of 200 $\mu$m, and its surface orientation is (1, 1, 0). An orifice flat is formed on the (1, 1, 0) surface. A resist 93 is formed on the bottom surface and the top surface (bottom surface in the drawing) of the silicon substrate 90. Next, the channel pattern is disposed at an angle of 35.3 degrees from the orifice flat. The desired vertical wall structure is formed when etching is done.

Figure 6C:
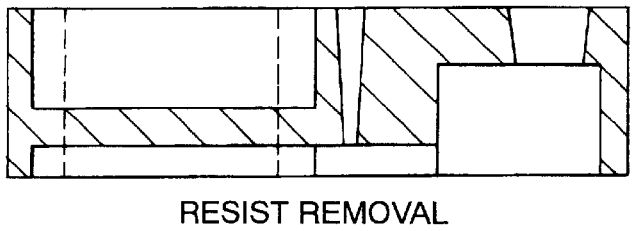
Figure 6D:
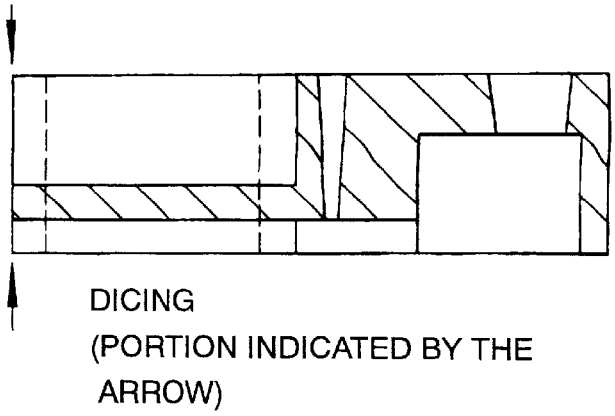

Next, the resist 93 is removed as shown in FIG. 6C. After that, the area indicated by an arrow in the silicon substrate 90 is cut off using a dicer to form the ink eject port (nozzle 54) as shown in FIG. 6D.

Figure 6E:
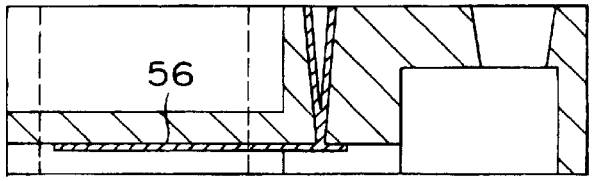

Next, as shown in FIG. 6E, a CrAu layer is formed inside the tapered through hole 91 by means of sputtering or CVD method from the back side of the silicon substrate 90, while a 0.1 μm CrAu layer for the electrode 56 is formed on the front side of the silicon substrate 90 by means of sputtering or CVD method. Materials such as ITO, $SnO_2$, Pt and other low resistance materials in addition to CrAu are applicable to the electrode 56.

Figure 6F:
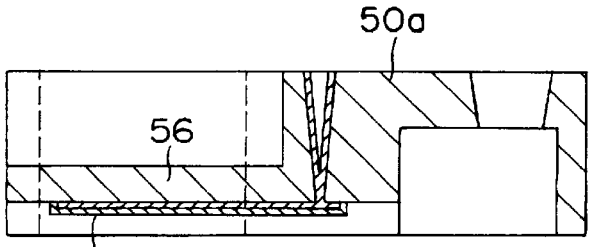

Next, as shown in FIG. 6F, a 0.1 μm SiC layer is formed by means of sputtering as a protection layer 94 of the electrode 56. Although $SiO_2$ and MgO in addition to SiC can be as the material for forming the protective layer, SiC is most preferable considering its excellent humidity resistance.

Incidentally, the other channel plate 50*b*, which is in a mirror image relation with the channel plate 50*a*, is to be made using the same procedure.

Figure 6G:
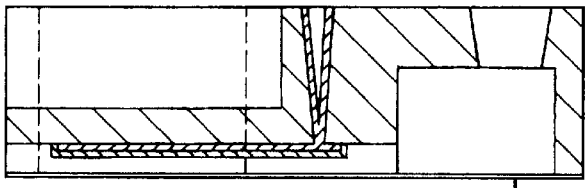
Figure 6H:
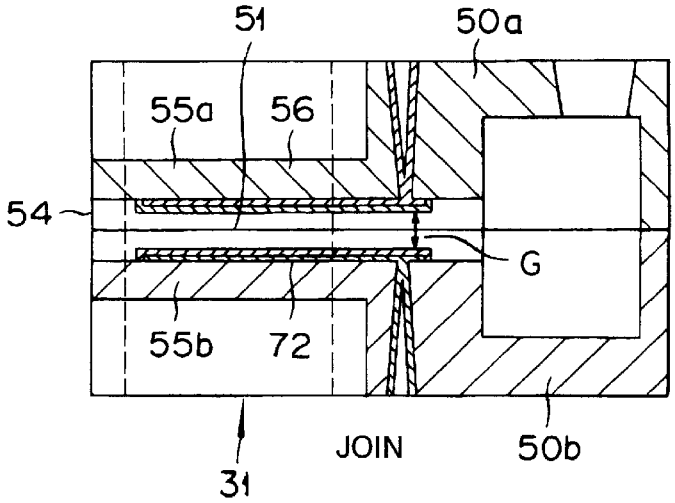

Next, a low melting point glass film 95 is formed on the junction surface between the channel plates 50*a* and 50*b* as shown in FIG. 6G. When the channel plates 50*a* and 50*b* are joined together as shown in FIG. 6H, the ink jet head 31 is completed. The thickness of the oscillating plates 55*a* and 55*b* is 3 μm and the gap G between the electrodes is 3 μm as well.

The ink jet 31 is a high efficient electrostatic actuator due to the constitution, in which the gap between the electrodes 56 and 72 is filled with ink that has a higher relative dielectric constant than air. Therefore, the gap G between the electrodes can be chosen to be extremely larger than that of a conventional head. Accordingly, manufacturing and assembling of the channel plates 50*a* and 50*b* as components of the ink jet head 31 are substantially easier. This also makes the head manufacturing easier and improves the available percentage.

Figure 7:
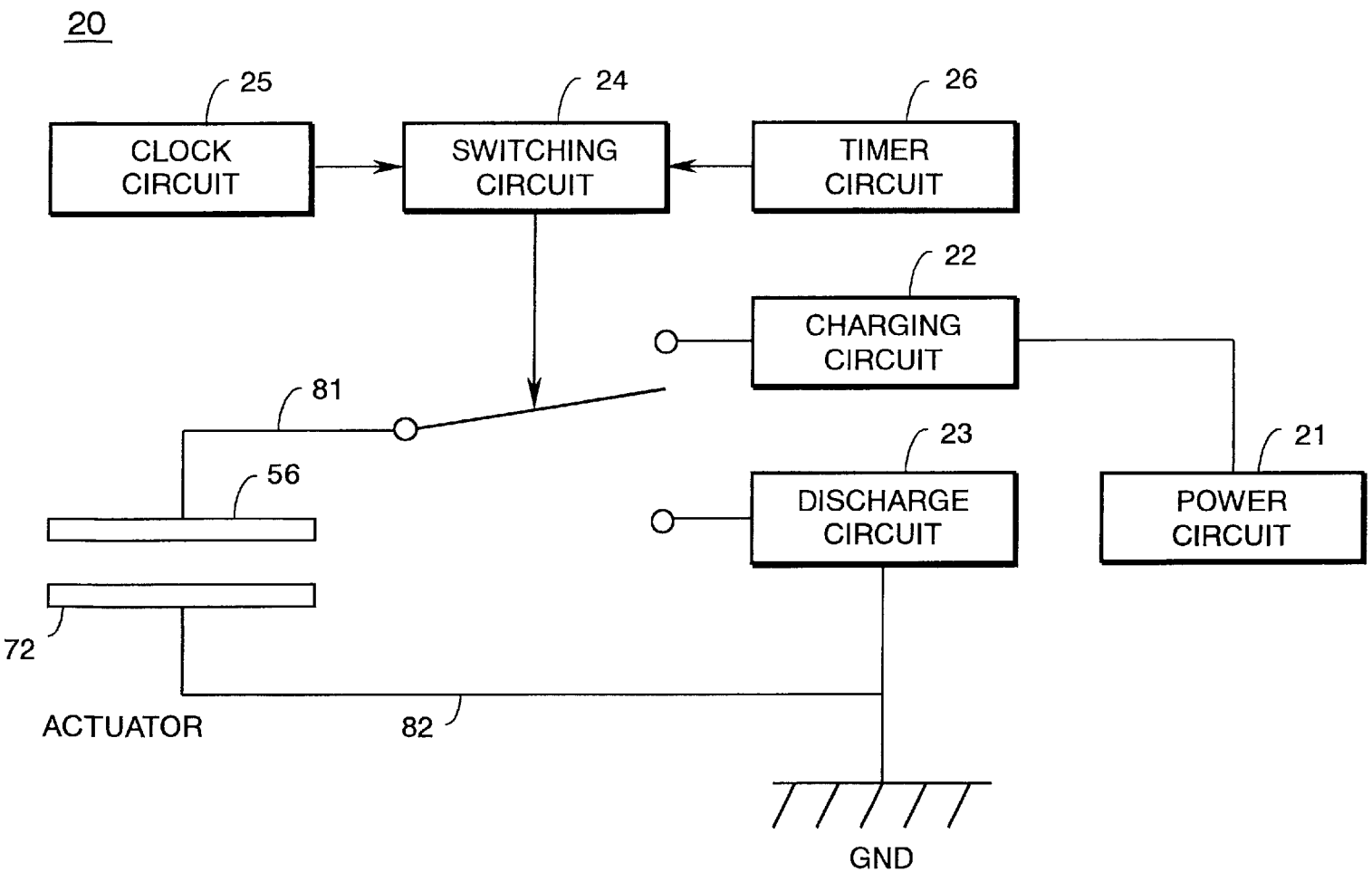
FIG. 7 is a block diagram of a drive circuit.

The electrodes 56 and 72 of the ink jet head 31 manufactured as above are connected to the drive circuit 20 as shown in FIG. 7.

The drive circuit 20 includes a charging circuit 22 connected to a power circuit 21, a grounded charging circuit 23, a switching circuit 24 that selectively connects the electrostatic actuator with the electrodes 56 and 72 to the charging circuit 22 or the discharging circuit 23 by means of a switch, a clock circuit 25 for generating clock pulses as the standard for the work timing, and a timer circuit 26 for controlling the charge timing and the discharge timing.

In order to eject ink, it is necessary to cause the pair of oscillating plates 55*a* and 55*b* to be attracted to each other sharply. The drive circuit 20 generates voltage pulses that cause such motions of the oscillating plates 55*a* and 55*b* to control the application and cut-off of the drive voltage to the electrodes 56 and 72. Therefore, in order to eject ink, first of all, the switch is connected to the charging circuit 22 to apply the voltage on the electrodes 56 and 72. Then, the voltage is cut-off. After a predetermined time, the switch is connected to the discharging circuit 23 to clear the remaining charge. The switch timing is controlled by the timer circuit 26.

When a drive voltage of 35V was applied to the ink jet head 31, it ejected an ink drop of about 60 picolitter. It was necessary to apply a drive voltage of 40V to eject an ink drop of the same volume in case of a conventional ink jet head using a single oscillating plate. Therefore, the ink jet head 31 can use a lower voltage compared to a conventional head. This is because the ink channel 51 of the ink jet head 31 is sandwiched between the pair of oscillating plates 55*a*, 55*b* and it is easier to achieve a larger volume change compared to the conventional case where only one oscillating plate is used.

Moreover, while the conventional type ink jet head with 0.3 μm gap G between the electrodes shorted out at 500 million cycles, the ink jet head 31 using 3 μm gap G between the electrodes according to the embodiment 1 still operated without shorting after two billion cycles. It is understood that the chance of the contact between the electrodes 56 and 72 is eliminated and the ink jet head 31 has less chance of being chronologically affected because the ink jet head 31 has a distance between the electrodes much larger than that of the conventional type. Thus, it is possible to provide an ink jet head with a higher reliability in terms of durability.

Embodiment 2

Figure 8:
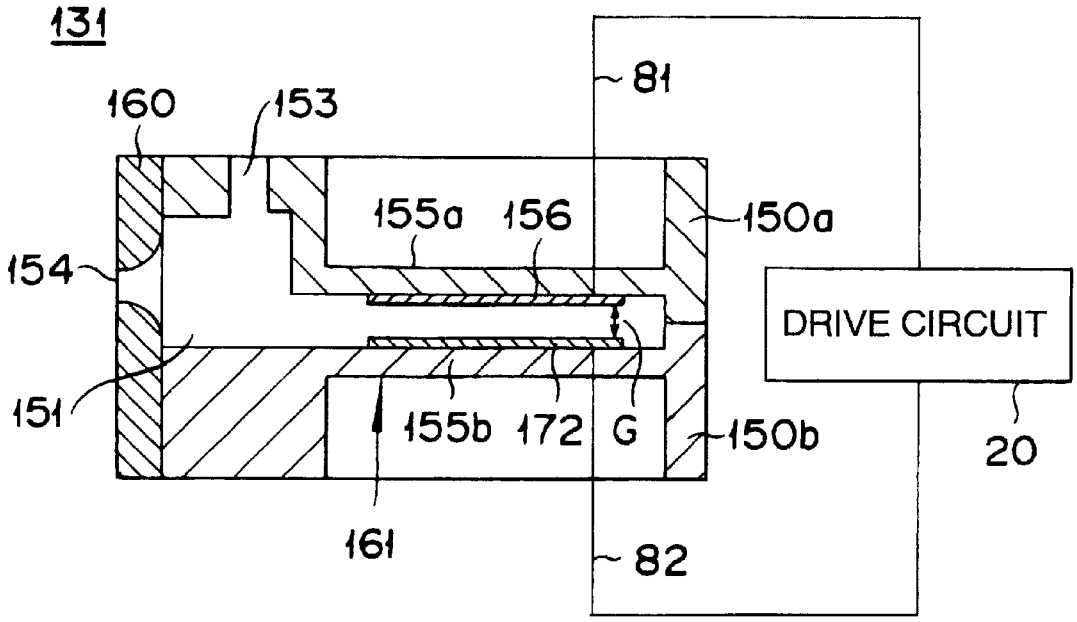
FIG. 8 is a sectional view of an ink jet head according to the embodiment 2.
Figure 9:
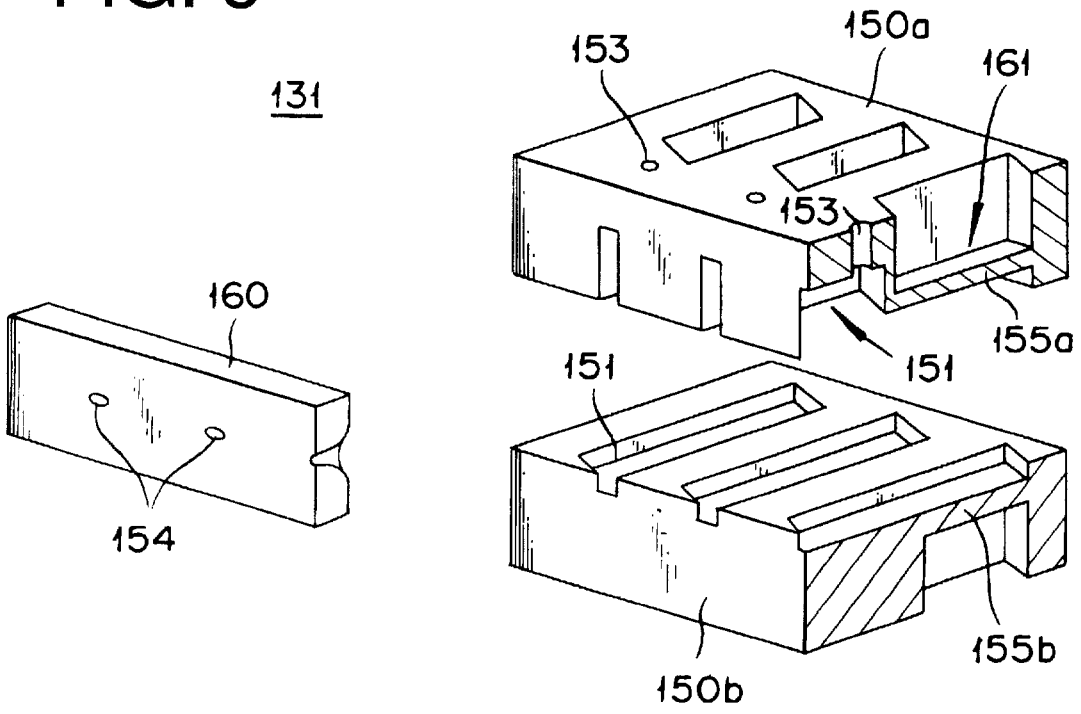
FIG. 9 is an exploded perspective view of the ink jet head shown in FIG. 8.

The ink jet head 131 shown in FIG. 8 and FIG. 9 is of an electrostatic type where an electrostatic actuator is used, and is different from the embodiment 1 in terms of the position of the oscillating plates. Specifically, while the space between the pair of oscillating plates 55*a* and 55*b* forms a portion of the ink passage in the embodiment 1, a pair of oscillating plates 155*a* and 155*b* is disposed slightly apart from the substantial ink passage from an inlet 153 to a nozzle 154 in case of the ink jet head 131. Therefore, the ink jet head 131 has an improved high speed printing capability compared to the embodiment 1.

As shown in FIG. 9, the ink jet head 131 includes two channel plates 150*a* and 150*b* joined together in the vertical direction in the drawing and a nozzle plate 160, which is joined on the side thereof. The channel plates 150*a* and 150*b* are made of single crystal silicon having a plurality of recesses and the nozzle plate 160 is provided with nozzles 154.

An extension 161 of the ink channel 151 is extending toward the backside (right side in FIG. 8) relative to the nozzle 154. The top wall and the bottom wall of this extension 161 constitute the oscillating plates 155*a* and 155*b*. Also, the first electrode 156 used as the common electrode is provided on the inside of the oscillating plate 155*a*, while the second electrode 172 used as the individual electrode is provided on the inside of the oscillating plate 155*b*. The inlet 153 is formed on the top surface of the channel plate 150*a* to supply ink from the ink chamber which is not shown.

The nozzle diameter and the inlet diameter are both chosen to be 23 μm. The nozzle plate 160 is made by Ni electro-casting. The methods of etching from the both sides of the silicon substrates, two stage etching, producing the through hole, forming of the electrodes, joining of the substrates, etc. are the same as in the embodiment 1. The materials for the electrodes and protective layer used in the embodiment 1 may be used here as well. The ejection operation is also the same as in the embodiment 1. Specifically, when a specified voltage from the drive circuit 20 is applied between the electrodes 156 and 172, the pair of oscillating plates 155*a* and 155*b* are attracted to each other so that the volume of the ink channel 151 contracts sharply. The pressure generated at this time causes an ink drop to be discharged from the nozzle 154. On the other hand, when the application of the voltage between the electrodes 156 and 172 is stopped causing an electric discharge, the oscillating plates 155*a* and 155*b* are restored to their original shapes due to their own restoring forces resulting from their rigidities, and thus increase the volume of the ink channel 151.

Same as in the embodiment 1, the ink jet head 131 with the aforementioned constitution uses ink with a large relative dielectric constant $\in_r$ of about 60 to fill the space between the electrodes 156 and 172. As a result, the gap G between the electrodes can be chosen to be as large as 3 $\mu$m. Thus, the manufacture of the ink jet head can be made easier and the reliability can be improved at the same time.

Moreover, since the oscillating plates 155*a* and 155*b* are disposed further back of the inlet 153 in relation to the nozzle 154 to be slightly away from the substantial ink passage. Thus, the oscillating plates 155*a* and 155*b* do not interfere with the flow of ink in the ink passage from the inlet 153 to the nozzle 154. This improves the high speed printing capability compared to the ink jet head 31 of the embodiment 1.

The channel plates used in the embodiment 1 and the embodiment 2 are made from silicon substrates by the wet etching method. However, the dry etching method using HF can be applied for manufacturing the channel plates as well. In that case, a channel pattern matching the mask can be formed on the etching surface irrespective of the surface orientation. As to the substrate material, photosensitive glass, ink resistant plastics such as polyimide or polysulfon can be used in addition to silicon. If a plastic material, such as polyimide and polysulfon, is used, the substrate can be made by a forming method such as molding.

Although the case of using a protection layer on the electrode has been described so far in order to prevent short circuit through ink, the protection layer is not needed if an ink with insulation properties is used.

While edge eject type ink jet heads were described in the embodiment 1 and the embodiment 2, the present invention is not limited to it, but rather it can be applied to an ink jet head of the face eject type as well as shown in the embodiment 3 below.

Embodiment 3

Figure 10:
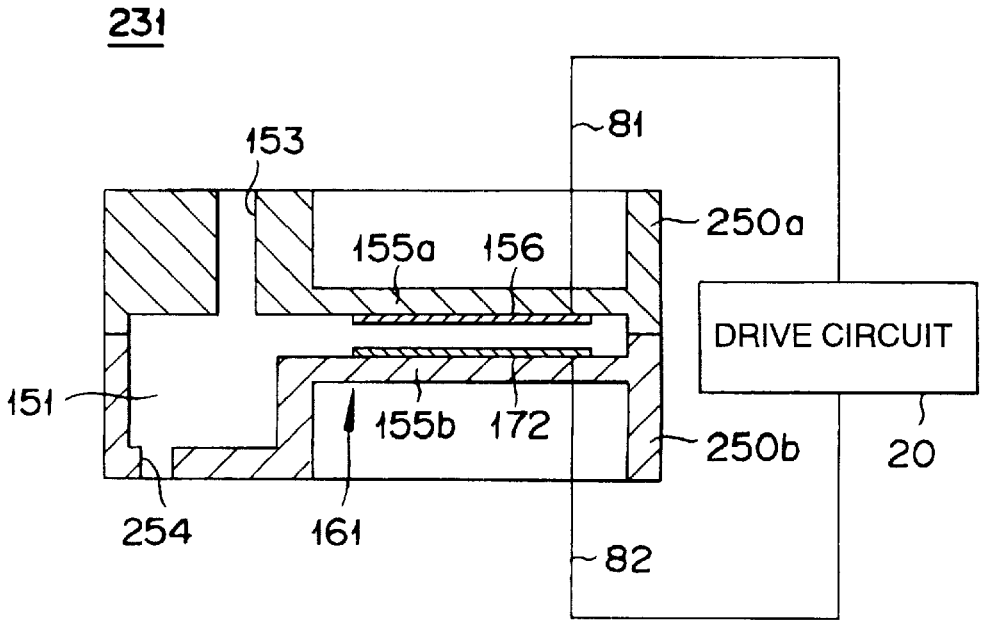
FIG. 10 is a sectional view of an ink jet head according to the embodiment 3.

The ink jet head 231 shown in FIG. 10 is of an electrostatic type using an electrostatic actuator and is different from the embodiment 1 and the embodiment 2 in terms of the nozzle constitution.

Specifically, the ink jet head 231 is of the face ejector type and includes two channels plates 250*a* and 250*b* stacked one on top of the other and has nozzles 254 on the bottom surface of the channel plate 250*b* as shown in the drawing. Members that are common to those of FIG. 8 are assigned with the same codes and their descriptions are omitted here.

Since a large gap can be selected between the electrodes in this constitution as well, the manufacture of the ink jet head can be made easier and the reliability can be improved also.

Embodiment 4

Figure 11:
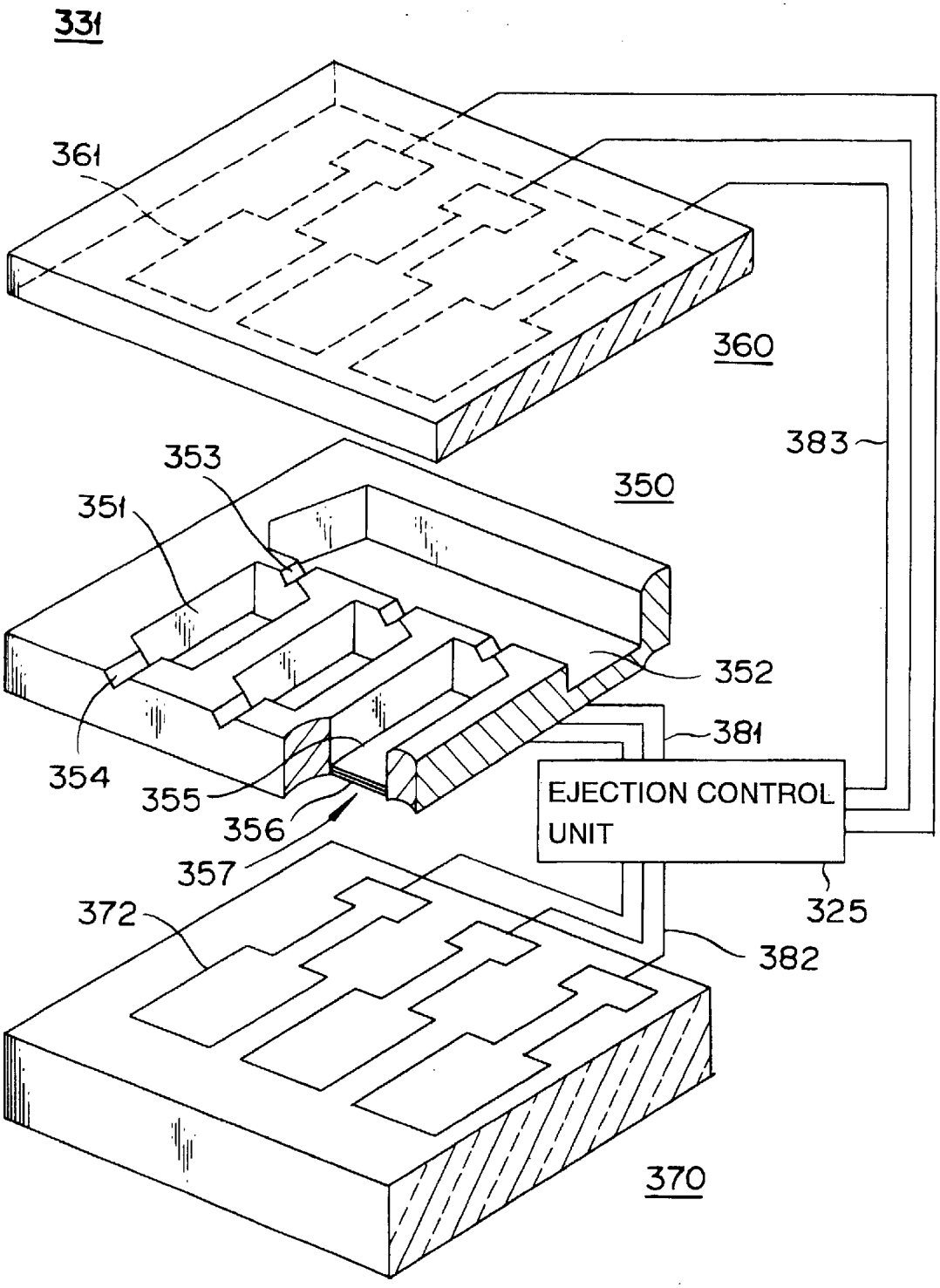
FIG. 11 is an exploded perspective view of an ink jet head according to the embodiment 4.

The ink jet head 331 shown in FIG. 11 is built into the printer. The general constitution of the ink jet printer and its operation are similar to the contents described in the embodiment 1 so that they are not repeated here. The head response of the ink jet head 331 is improved by means of increasing the drive frequency, or the frequency of applying a voltage between a pair of electrodes in case of continuous printing as described later.

As shown in the drawing, the ink jet head 331 has a multi-layered structure consisting of three elements, i.e., a channel plate 350, a top plate 360 that covers the top of the channel plate 350 as indicated in the drawing, and a glass substrate 370. The channel plate 350 includes ink channels 351, an ink chamber 352, inlets 353, nozzles 354, oscillating plate 355 each provided with a first electrode 356 that serves as a common electrode, and spaces 357. The glass substrate 370 has second electrodes 372 that serves as individual electrodes formed thereon. The second electrode 372 is disposed facing and separated by spaces 357 from the first electrode 356 that is provided on the oscillating plate 355 of the channel plate 350.

The nozzles 354 are provided on the side surface of the ink jet head 331 as indicated on the drawing. The oscillating plate 355 serves the purpose of ejecting ink through the nozzle 354 by means of causing the internal pressure change of the ink channel 351 when it deforms. The ink chamber 352 contains the ink to be supplied to the ink channel 351. The ink stored in the ink chamber 352 is fed into the ink channel 351 through the inlet 353.

The gap G formed by the space 357 between the first electrode 356 and the second electrode 372 is set to 0.3 $\mu$m. The first electrode 356 provided on the oscillating plate 355 consists of an impurity conductive layer formed by diffusing boron as described later.

The first electrode 356 and the second electrode 372 are connected to an ejection control unit 325, which is the driving means for the oscillating plate, by means of wires 381 and 382. The wire 381 connected to the first electrode 356 is grounded. The voltage from the ejection control unit 325 is applied to the second electrode 372 via the wire 382. The oscillating plate 355 is deformed as a result of a predetermined voltage applied between the first and the second electrodes 356 and 372.

Figure 12:
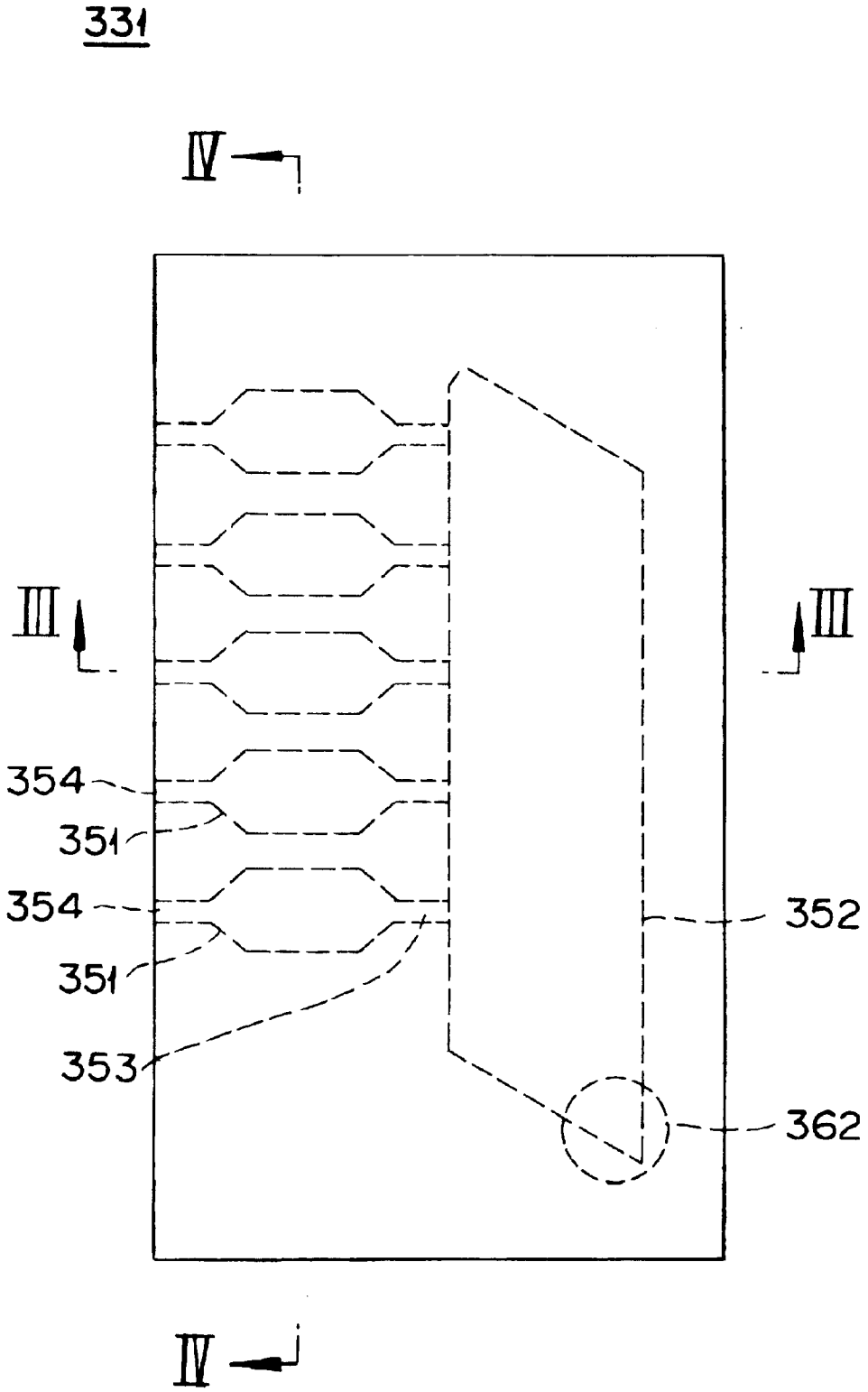
FIG. 12 is a plan view of the ink jet head seen through the channel plate of FIG. 11.
Figure 13:
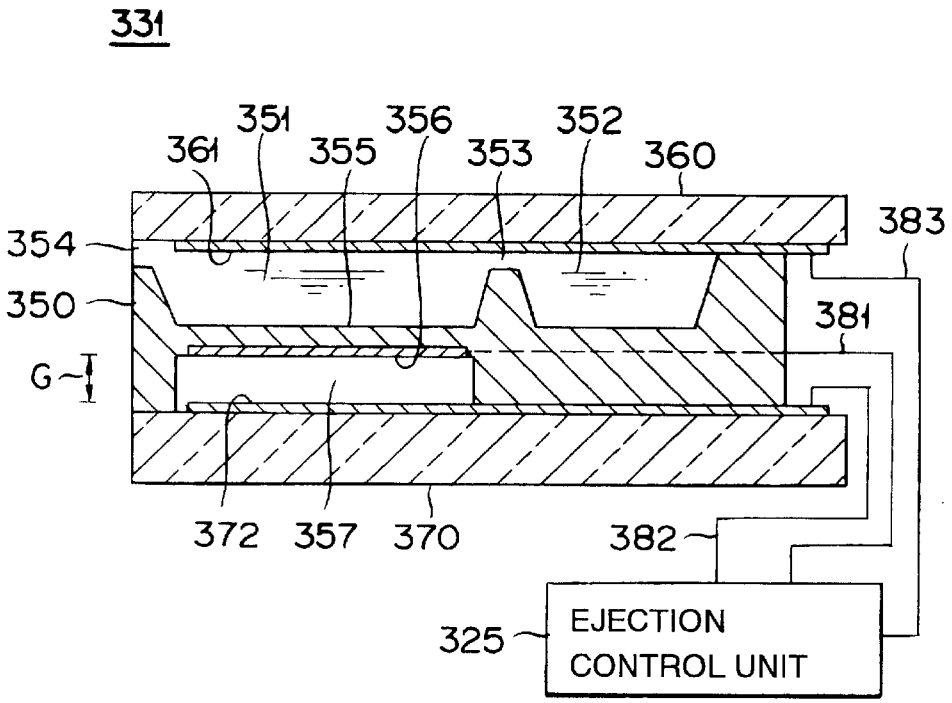
FIG. 13 is a sectional view along the line III—III of FIG. 12.
Figure 14:
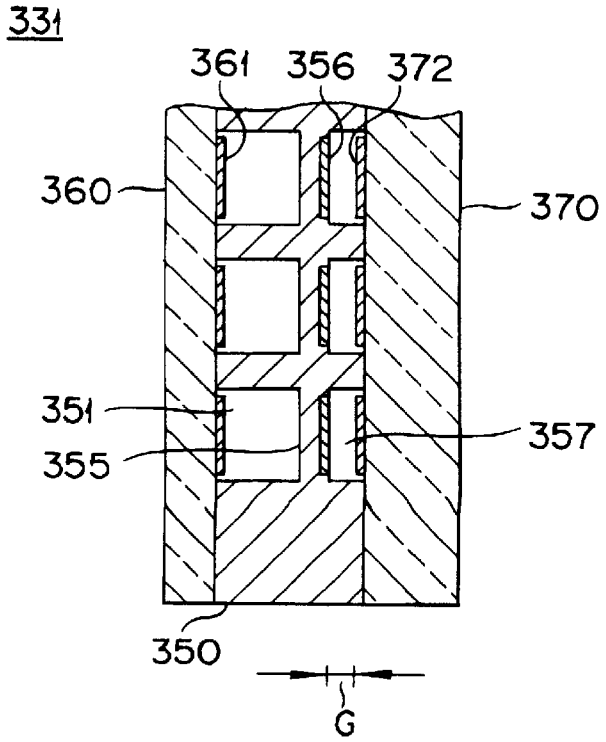
FIG. 14 is a sectional view along the line IV—IV of FIG. 12.

FIG. 13 is a sectional view along the line III-III of FIG. 12, and FIG. 14 is a sectional view along the line IV-IV of FIG.12. As shown in FIG. 11, FIG. 13 and FIG. 14, the ink jet head 331 has third electrodes 361 provided at the top plate 360. The third electrode 361 is an individual electrode separated by the ink channel 351 and it holds a position opposing the first electrode 356. In other words, the third electrode 361 is facing the oscillating plate 355 across a space, and is positioned relative to the first electrode 356 on the side opposite to the side the second electrode 372 is located. Therefore, the gap G between the first electrode 356 and the third electrode 361 depends on the depth of the ink channel 351. The depth of the ink channel 351 is set to 30 $\mu$m. The third electrode 361 is connected to the ejection control unit 325 via a wire 383. Therefore, the third electrode 361 receives a specified voltage from the ejection control unit 325 via the wire 383.

Next, the method of manufacturing the ink jet head 331 will be described as an example.

The ink jet head 331 is manufactured using various manufacturing processes such as the semiconductor manufacturing process and the micromachine manufacturing process. It goes without saying that the present invention is applicable to an ink jet head manufactured by a method that is not described here.

First, the method of manufacturing the channel plate 350 shown in FIG. 13 will be described referring to FIGS. 15A to 15C.

Figure 15A:
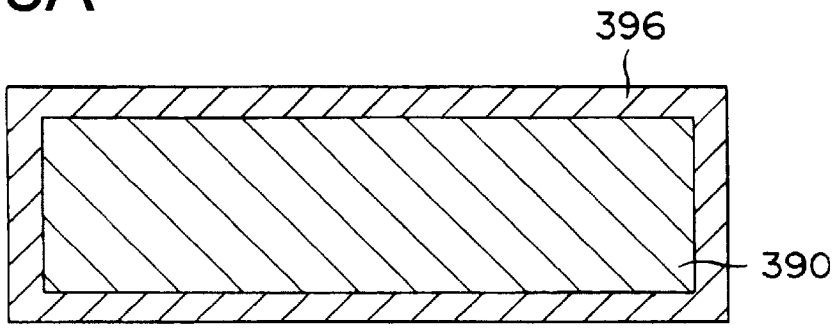
FIGS. 15A to 15C are sectional views for describing the method of manufacturing the channel plate of FIG. 13.
Figure 15B:
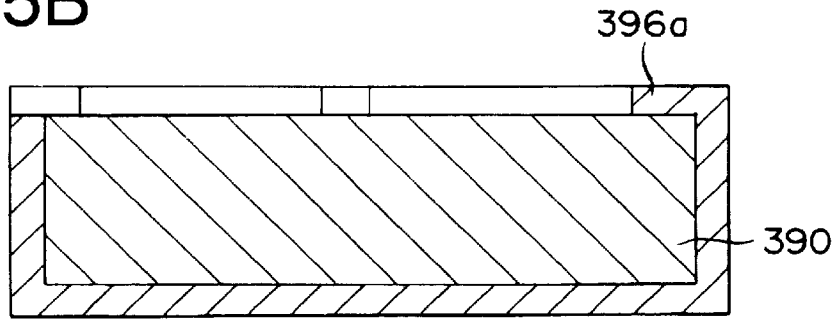
Figure 15C:
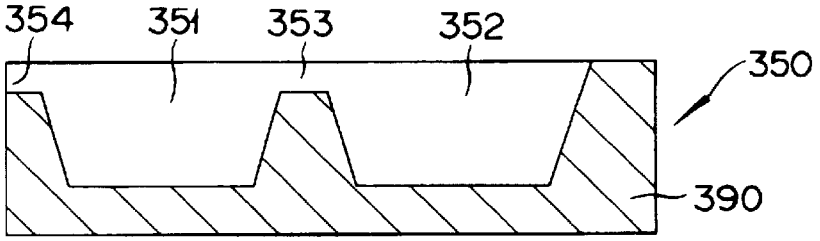

A silicon substrate 390 is lapped to about 40 $\mu$m as shown in FIG. 15A. Next, an oxide layer 396 is formed on the entire surface of the silicon substrate 390 by the thermal oxidizing method. The oxide layer 396 on the top surface (as shown in the drawing) of the silicon substrate 390 is then processed with patterning by the known photolithography and the dry etching methods to form the etching mask 396*a* shown in FIG. 15B. The etching mask 396*a* has openings for defining the shapes of the ink channels 351, ink chamber 352, inlets 353, and nozzles 354.

Next, the silicon substrate 390 having the etching mask 396*a* formed by patterning the oxide layer 396 is etched anisotropically with KOH solution. The surface orientation of the silicon substrate 390 is (1, 1, 0) or (1, 0, 0). The anisotropic etching performed with the KOH solution stops automatically when the (1, 1, 1) surface of the silicon substrate is exposed. Therefore, by adjusting the size of the openings that become the nozzles 354 and inlets 353 to form the etching mask 396*a,* it is possible to control the etching depths in opening areas to desired values. Also, the sizes of the openings that are to be the ink channels 351 and inlets 353 as well as the etching time are adjusted in order to make the depth of the areas that form oscillating plates 355 be about 6.5 μm. The etching by the KOH solution forms properly tapered surfaces on the side walls of the ink channel 351 and ink chamber 352 by exposing the (1, 1, 1) surface.

Next, the etching mask 396*a* formed by the oxide layer 396 is removed. As a result, the ink channels 351, ink chamber 352, inlets 353, and nozzles 354 are formed on the silicon substrate 390 as shown in FIG. 15C. The channel plate 350 thus produced has a plurality of ink channels 351 and a plurality of nozzles 354, so that an ink jet head ejects a plurality of ink drops simultaneously.

Next, the space 357 is formed on the backside of the silicon substrate 390 to produce a 0.3 μm gap G between the electrodes using a method similar to the method described above. Thus, the oscillating plate 355 shown in FIG. 13, etc., is formed on the silicon substrate 390.

A resist pattern is formed on the silicon substrate 390 by the photolithography method. The resist pattern has openings for the oscillating plate 355 and the lead line that electrically connect the first electrode 356 formed on the oscillating plates 355 and the wires 381 that connect to the ejection control unit 325. Next, boron is implanted into the opening areas for the oscillating plate 355 and the lead lines. As a result, the impurity diffusion layer that becomes the first electrode 356 and the lead lines is formed as shown in FIG. 13. After that, an oxide layer is formed on the entire surface of the silicon substrate 390 by a thermal oxidation process. Specifically, the insulation layer is formed on the surface of the oscillating plate 355 that is located on the backside of the silicon substrate. This insulation layer is formed to prevent the short circuit between the first electrode 356 and the second electrode 372.

Next, the formation of the glass substrate 370 where the second electrode 372 is formed will be described.

First, an ITO layer (indium oxide layer containing tin) is formed on the glass substrate 370. The portion where the ITO layer is formed consists of an area where it faces the oscillating plate 355 of the channel plate 350 and the area adjacent to it when they are joined as shown in FIG. 13. In addition, a boro-silicated glass substrate is used as the glass substrate 370. Consequently, the second electrode 372 and the lead line that connect the second electrode 372 and the wire 382 are formed on the glass substrate 370. In case of an ink jet head that has a plurality of ink channels and a plurality of nozzles, the second electrode and the lead line are formed for each ink channel.

Next, a protection layer such as a SiFH layer or a $SiO_2$ layer is formed covering the entire surface of the side where the second electrode 372 is formed to a thickness of about 1 μm. This protection layer is to prevent the deterioration of the drive electrode due to the ambient humidity. Therefore, the protection layer is not patterned but rather covers the entire surface of the glass substrate 370.

The depth of the space 357 is selected in such a way that the gap G, or the distance between the first electrode 356 (insulation layer surface) and the second electrode 372 (SiFH layer surface) to be formed is to be 0.1 to 1 μm, or more preferably 0.1 to 0.5 μm in terms of a lower drive voltage. In case of this embodiment, the gap G between the electrodes is chosen to be 0.3 μm as mentioned before.

The space 357 is formed by digging the area of the oscillating plate 355 of the silicon substrate 390 that constitutes the channel plate 350 from the backside (bottom side in the drawing) by etching. However, the space 357 can be formed in the glass substrate 370 alternatively. Specifically, it is possible to form the space 357 by forming a recess with a specified depth in the area of the glass substrate 370 where it faces the oscillating plate 355 of the channel plate 350 when they are joined together as shown in FIG. 13.

Next, the formation of the top plate 360 will be described.

The top plate 360 consists of a boro-silicated substrate as in the case of the glass substrate 370 where the second substrate 372 is provided. An ink supply port 362 for introducing ink from the ink cassette disposed above into the ink chamber 352 is formed in the top plate 360. Next, the ITO layer is formed on the bottom surface of the top plate 360 in the area that faces the oscillating plate 355 of the channel plate 350 and in the specified area adjacent to it. In consequence, the third electrode 361 and the lead line that connects the third electrode 361 and the wire 383 are formed on the bottom side of the glass substrate 360. In case of an ink jet head that has a plurality of ink channels and a plurality of nozzles as shown in FIG. 11, the third electrode and the leads line are formed for each ink channel.

The ink channel plate 350, the glass substrate 370 and the top plate 360 manufactured as above are joined by the anode joint method as shown in FIG. 11. The lead line as the impurity diffusion layer formed on the oscillating plate 355 of the channel plate 350, the lead line formed on the glass substrate 370 and the lead line formed on the top plate 360 are connected to the wires 381, 382 and 383 respectively to complete the manufacture of the ink jet head.

Next, the inks as used will be described.

As shown in the following Table, four types of ink, i.e., black (K), yellow (Y), magenta (M), and cyan (C) were used. These inks were color adjusted with dyes. However, the inks may be adjusted with pigments instead of dyes.

TABLE

| | Color | | | |
|---|---|---|---|---|
| Composition | K | Y | M | C |
| Distilled water | 82.5 | 82.5 | 82.5 | 82.5 |
| Dye | 4.6 B/BK-SP (Bayer) | 2.5 B/CA-Y (Bayer) | 2.5 F/R-FF3282 (BASF) | 3.0 B/CY-BG (Bayer) |
| Diethylene glycol | 3.0 | 3.0 | 3.0 | 3.0 |
| Glycerin | 5.3 | 6.6 | 7.4 | 6.9 |
| Triethylene glycol monobutyl ether | 4.0 | 4.0 | 4.0 | 4.0 |
| Surfactant: Olefin E1010 (Nissin Chemical Ind. Ltd.) | 0.2 | 1.o | 0.2 | 0.2 |
| pH adjuster: $NaHCO_3$ | 0.2 | 0.2 | 0.2 | 0.2 |
| Stabilizer: Triethanol amine | 0.2 | 0.2 | 0.2 | 0.2 |

(Unit: weight %)

Figure 16:
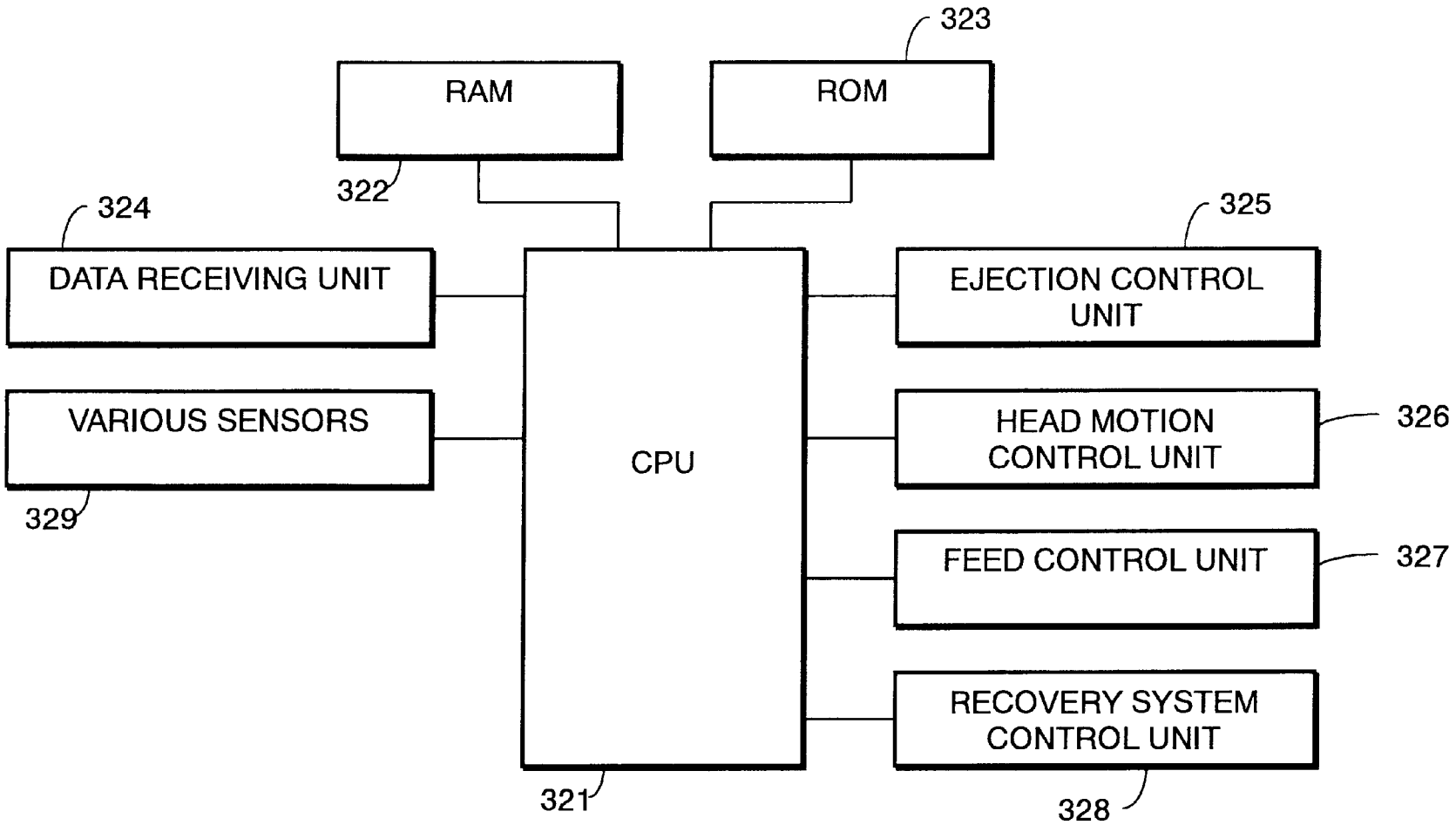
FIG. 16 is a block diagram for describing the constitution of the controller of the ink jet printer.

Next, the controller of the ink jet printer will be described referring to FIG. 16.

The controller of the ink jet printer includes a CPU 321, a RAM 322, a ROM 323, a data receiving unit 324, an ejection control unit 325, a head motion control unit 326, a feed control unit 327, a recovery system control unit 328, and various sensors 329. The data receiving unit 324 is connected to a machine such as a host computer and receives image data to be recorded.

The CPU 321 that controls the entire system uses the RAM 322 as needed to execute a program recorded in the ROM 323. The program has a routine for recording the image on the sheet, and a routine for restoring the nozzle surface of the head unit to a good condition. Specifically, the former routine controls the ejection control unit 325, the head motion control unit 326, the feed control unit 327, and various sensors 329 based on the image data inputted via the data receiving unit 324 and the latter routine controls the recovery system control unit 328 as needed by processing the information from various sensors 329.

The ejection control unit 325 is controlled by the CPU 321 to drive the ink jet head 331 in the head unit. More specifically, the pulse voltage that corresponds to the image data is applied to the second electrode and the third electrode in specified timings by the ejection control unit 325. Incidentally, the ejection control unit 325 includes a delay circuit, a charge/discharge circuit, a reverse circuit, and a reverse amplifying circuit.

The head motion control unit 326 is controlled by the CPU 321 to drive the motor that moves the carriage that carries the head unit. The feed control unit 327 is controlled by the CPU 321 to drive the sheet feed roller. Moreover, the recovery system control unit 328 is controlled by the CPU 321 to drive the motor and other things that are needed to restore the nozzle surface of the head unit to a good condition.

Figure 17A:
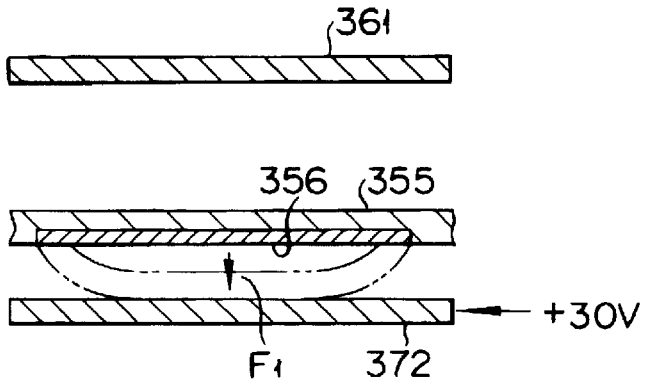
FIG. 17A and FIG. 17B are expanded sectional views for describing the motions of the oscillating plate when it ejects an ink drop.
Figure 17B:
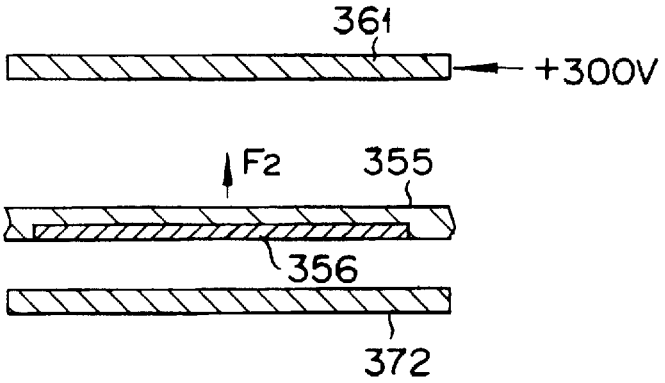

Next, the action of the ink jet head, or the action of the oscillating plate 355 during the ejection of an ink drop will be described referring to FIG. 17A and FIG. 17B.

As the first step in ejecting an ink drop, a drive voltage is applied between the first electrode 356 and the second electrode 372. The oscillating plate 355 is attracted to the second electrode 372 due to an electrostatic force generated by the drive voltage applied as shown in FIG. 17A. This causes the oscillating plate 355 to warp toward the second electrode 372 as shown with the two-dot chain lines in the drawing. The ink in the ink chamber 352 flows through the inlet 353 into the ink channel 351. The first electrode 356 formed on the oscillating plate 355 is grounded. Therefore, the positive voltage, e.g., a 30 V drive voltage is applied to the second electrode (drive electrode) 372. This drive voltage generates the force F1 to be applied to the oscillating plate 355 as shown in the drawing.

The drive voltage is held for a predetermined time, e.g., several microseconds to tens microseconds by various circuits in the ejection control unit 325. Subsequently, the drive voltage is cut off and an auxiliary voltage is applied between the first electrode 356 and the third electrode 361 within a predetermined time. Since the first electrode 356 formed in the oscillating plate 355 is grounded, the positive voltage, e.g., 300V, is applied to the third electrode 361.

In order to apply a voltage effectively minimizing the waste of energy, the time is preferably 0.1 to 10 microseconds. The reason is as follows: If the predetermined time is chosen to be less than 0.1 microsecond, the predetermined time is shorter than the time required for the oscillating plate 355 to restore back to the restoration position, or the original position, although it depends on the deformation due to the drive voltage. Therefore, the tensile force is developed during the restoration of the oscillating plate 355, which causes an energy loss. In other words, the loss is less if the tensile force is provided after the restoration. On the other hand, if the predetermined time is chosen to be longer than 10 microseconds, the predetermined time is longer than the time required for the oscillating plate 355 to pass the original position and oscillate one cycle, although it depends on the deformation due to the drive voltage. Therefore, the tensile force is developed at the timing when it returns to the original position after one oscillation. This also causes energy loss and is not desirable.

Thus, the oscillating plate 355 that has been attracted toward the second electrode 372 due to the application of the drive voltage returns to the original position on account of the restoration force of the oscillating plate 355 itself after the drive voltage cut-off. At about the same instant, a force F2 is applied to the oscillating plate 355 due to the application of the auxiliary voltage as shown in FIG. 17B. Therefore, the oscillating plate 355 is pulled rapidly away from the second electrode 372.

The volume of the ink channel 351 contracts sharply and develops a pressure. As a result, the ink which has filled the ink channel 351 flies out as a drop from the nozzle 354 and lands on the sheet 2 to form a specified image.

In the embodiment 4, the third electrode 361 is positioned relative to the first electrode 356 on the side opposite to the side the second electrode 372 is located, the oscillating plate 355 is pulled toward the second electrode 372 when the drive voltage is applied between the first electrode 356 and the second electrode 372, and the auxiliary voltage is applied between the first electrode 356 and the third electrode 361 when the oscillating plate 355 returns to the original position by its own restoring force.

With this constitution, the restoring force of the oscillating plate 355 is enhanced since the oscillating plate 355 is pulled forcibly away from the second electrode 372 by means of an electrostatic force. This causes the oscillating plate 355 return to its original position quicker than when it depends on the restoring force of the oscillating plate 355 alone. In other words, the tracking capability of the mechanical constitution including the oscillating plate is improved and thus the drive frequency of the ink jet head can be increased. This means that the preparation for the next printing can be done quicker so that the head response can be improved to enable high speed printing.

The ejecting speed of the ink drop ejected from the nozzle 354 was 8 meters per second when the third electrode 361 was not provided. On the contrary, the ejecting speed was increased to 10 meters per second as a result of the enlargement of the restoring force of the oscillating plate 355 when the third electrode 361 was provided. This will prevent the misplacement of the ink drop on its landing on the recording medium, which otherwise may be caused by the time lag between the ejection and the landing on the recording medium. Since the fluctuation of the ink drop flight is reduced, the image distortion is minimized and the better image recording is accomplished.

It is obvious that this invention is not limited to the particular embodiments shown and described above but may be variously changed and modified by any person of ordinary skill in the art without departing from the technical concept of this invention.

In the embodiment 4, as shown in FIG. 11, a case of forming the third electrode 361 and the lead line individually for each ink channel 351 was described. However, the present invention is not limited to such a constitution. For example, the lead lines of a plurality of third electrodes 361 can be connected to form a single common electrode so that the auxiliary voltage can be applied to the common electrode. With such a constitution, it is possible to reduce the manufacturing cost because the constitution of each circuit in the ejection control unit 325 is simplified.

What is claimed is:

1. An electrostatic ink jet head having a set of elements comprising:

an ink channel that communicates with a nozzle that ejects ink;

a pair of non-piezoelectric oscillating plates that are disposed opposing to each other on walls of said ink channel; and a pair of electrodes provided in contact with said non-piezoelectric oscillating plates, respectively, wherein a voltage is applied between said electrodes.

2. An electrostatic ink jet head in accordance with claim 1, wherein said ink is ejected by applying a voltage between said electrodes.

3. An electrostatic ink jet head in accordance with claim 1, wherein a plurality of the sets of elements are arranged.

4. An electrostatic ink jet head in accordance with claim 4, wherein one of said electrodes is used as a common electrode.

5. An ink jet head comprising:

an ink channel that communicates with a nozzle that ejects ink;

a pair of oscillating plates that are disposed opposing to each other on walls of said ink channel; and a pair of electrodes provided in contact with said oscillating plates, respectively;

wherein a voltage is applied between said electrodes; and wherein said electrodes are disposed respectively on an inside of said oscillating plates provided opposing to each other.

6. An electrostatic ink jet recording apparatus having a set of elements comprising:

an ink channel that communicates with a nozzle that ejects ink;

a pair of non-piezoelectric oscillating plates that are disposed opposing to each other on walls of said ink channel;

a pair of electrodes disposed in contact with said non-piezoelectric oscillating plates, respectively; and a controller for controlling a voltage to be applied between said electrodes.

7. An electrostatic ink jet recording apparatus in accordance with claim 6, wherein ink is ejected by applying a voltage between said electrodes.

8. An electrostatic ink jet recording apparatus in accordance with claim 6, wherein a plurality of the sets of elements are provided.

9. An electrostatic ink jet recording apparatus in accordance with claim 6, wherein one of said electrodes is used as a common electrode.

10. An electrostatic ink jet recording apparatus in accordance with claim 6, wherein said controller discharges electric charges of said electrodes.

11. An ink jet recording apparatus comprising:

an ink channel that communicates with a nozzle that ejects ink;

a pair of oscillating plates that are disposed opposing to each other on walls of said ink channel;

a pair of electrodes disposed in contact with said oscillating plates, respectively; and a controller for controlling a voltage to be applied between said electrodes;

wherein a plurality of sets of said composing elements are provided; and wherein said electrodes are disposed respectively on an inside of said oscillating plates provided opposing to each other.

12. An ink jet recording apparatus comprising:

an ink channel that communicates with a nozzle that ejects ink;

a pair of oscillating plates that are disposed opposing to each other on walls of said ink channel;

a pair of electrodes disposed in contact with said oscillating plates, respectively; and a controller for controlling a voltage to be applied between said electrodes;

wherein relative dielectric constant of ink to be filled in said ink channel is larger than 1.

13. An ink jet head comprising:

an ink channel that communicates with a nozzle that ejects ink;

an oscillating plate that is disposed facing said ink channel;

a first electrode disposed on said oscillating plate, a side where said first electrode is disposed being opposite to a side that faces said ink channel;

a second electrode that is disposed opposing said first electrode; and a third electrode located relative to said first electrode on a side opposite to a side said second electrode is located.

14. An ink jet head in accordance with claim 13, wherein said third electrode is opposing said oscillating plate across said ink channel.

15. An ink jet head in accordance with claim 13, wherein said second electrode is separated from said first electrode by a space.

16. An ink jet recording apparatus comprising:

an ink channel that communicates with a nozzle that ejects ink;

an oscillating plate that is disposed facing said ink channel;

a first electrode disposed on said oscillating plate, a side where said first electrode is disposed being opposite to a side that faces said ink channel;

a second electrode that is disposed opposing said first electrode;

a third electrode located relative to said first electrode on a side opposite to a side said second electrode is located; and a controller for controlling application of voltages to said electrodes.

17. An ink jet recording apparatus in accordance with claim 16, wherein said third electrode is opposing said oscillating plate across said ink channel.

18. An ink jet recording apparatus in accordance with claim 16, wherein said controller applies a voltage between said first and third electrodes within a predetermined time after stopping application of a voltage between said first and second electrodes.

19. An ink jet recording apparatus in accordance with claim 18, wherein said predetermined time is 0.1 to 10 microseconds.

20. An ink jet recording apparatus in accordance with claim 16, wherein said voltage applied between said first and second electrodes is different from said voltage applied between said first and third electrodes.

21. A method for driving an ink jet head comprising an oscillating plate that is disposed facing an ink channel, a first electrode disposed on said oscillating plate, a side where said first electrode is disposed being opposite to a side that faces said ink channel, a second electrode that is disposed opposing said first electrode, and a third electrode located relative to said first electrode on a side opposite to a side said second electrode is located, said method comprising the steps of:

a first voltage application step that applies a voltage between said first and second electrodes; and a second voltage application step that applies a voltage between said first and third electrodes.

22. A method in accordance with claim 21, wherein said second voltage application step is executed after a predetermined time after said first voltage application step is stopped.

23. A method in accordance with claim 22, wherein said predetermined time is 0.1 to 10 microseconds.

24. A method in accordance with claim 21, wherein said voltage used in said first voltage application step is different from said voltage used in said second voltage application step.

25. An electrostatic ink jet head comprising:

an ink channel that is defined by a plurality of surfaces that include a first surface and a second surface opposing to said first surface through said ink channel, said first surface being a main surface of a non-piezoelectric oscillating plate, said ink channel communicating with a nozzle for ejecting ink therefrom;

a first electrode provided at a position corresponding to the first surface; and a second electrode provided at a position corresponding to the second surface;

wherein an electrical field can be generated between said first and second electrodes by applying an electrical voltage therebetween.

26. An electrostatic ink jet head as claimed in claim 25 wherein one of said electrodes is a common electrode.

* * * * *

UNITED STATES PATENT AND TRADEMARK OFFICE

CERTIFICATE OF CORRECTION

PATENT NO. : 6,309,056 B1
DATED : October 30, 2001
INVENTOR(S) : Yasuhiro Sando et al.

It is certified that error appears in the above-identified patent and that said Letters Patent is hereby corrected as shown below:

Column 5,
Line 2, delete “detailed”, and insert -- detail --.

Column 6,
Line 58, after “50b”, insert -- . --.

Column 12,
Line 55, in the Table, after “Surfactant 0.2”, delete “l.o”, and insert -- 1.0 --.

Column 15,
Lines 23 and 24, delete “in accordance with claim 4,”, and insert -- in accordance with claim 3, --.

Signed and Sealed this

Sixteenth Day of July, 2002

*Attest:*

*Attesting Officer*

JAMES E. ROGAN
*Director of the United States Patent and Trademark Office*